US009903160B2

(12) United States Patent
Galler et al.

(10) Patent No.: US 9,903,160 B2
(45) Date of Patent: Feb. 27, 2018

(54) ROD MANIPULATOR FOR A MINING DRILL RIG

(71) Applicant: SANDVIK INTELECTUAL PROPERTY AB, Sandviken (SE)

(72) Inventors: Thomas Galler, Katsch/Mur (AT); Johannes Leitner, Krakaudorf (AT)

(73) Assignee: SANDVIK INTELLECTUAL PROPERTY AB, Sandviken (SE)

( * ) Notice: Subject to any disclaimer, the term of this patent is extended or adjusted under 35 U.S.C. 154(b) by 0 days.

(21) Appl. No.: 15/129,766

(22) PCT Filed: Mar. 9, 2015

(86) PCT No.: PCT/EP2015/054797

§ 371 (c)(1),
(2) Date: Sep. 27, 2016

(87) PCT Pub. No.: WO2015/144424

PCT Pub. Date: Oct. 1, 2015

(65) Prior Publication Data

US 2017/0204666 A1 Jul. 20, 2017

(30) Foreign Application Priority Data

Mar. 28, 2014 (EP) ..... 14162337

(51) Int. Cl.

| | |
|---|---|
| ***E21B 7/02*** | (2006.01) |
| ***E21B 19/14*** | (2006.01) |
| ***E21B 3/02*** | (2006.01) |
| ***E21B 19/08*** | (2006.01) |
| ***E21D 20/00*** | (2006.01) |

(52) U.S. Cl.

CPC ..... *E21B 7/027* (2013.01); *E21B 3/02* (2013.01); *E21B 19/08* (2013.01); *E21B 19/14* (2013.01); *E21D 20/003* (2013.01)

(58) Field of Classification Search

None

See application file for complete search history.

(56) References Cited

U.S. PATENT DOCUMENTS

| | | | | |
|---|---|---|---|---|
| 2,754,087 A * | 7/1956 | Johnson | E21B 7/022 173/27 |
| 3,902,561 A * | 9/1975 | Friberg | E21B 19/20 175/52 |
| 5,791,822 A * | 8/1998 | Edmondson | E21D 20/006 405/259.1 |
| 5,795,107 A * | 8/1998 | Edmondson | E21B 19/20 29/810 |

(Continued)

FOREIGN PATENT DOCUMENTS

| | | |
|---|---|---|
| DE | 102007038265 B3 | 2/2009 |
| EP | 0470061 A2 | 2/1992 |
| EP | 1533470 A1 | 5/2005 |

*Primary Examiner* — Shane Bomar
(74) *Attorney, Agent, or Firm* — Corinne R. Gorski

(57) ABSTRACT

A bolting drill rig arranged to be mountable at a mobile mining machine. The drill rig includes a main frame mounting an axially movable drive unit and head to press against the roof or wall of the mine. A drill rod manipulator assembly is mounted at the main frame to one side of the drive unit and configured to transport a drill rod between a drilling position and a rod storage position.

12 Claims, 8 Drawing Sheets

(56) References Cited

U.S. PATENT DOCUMENTS

| | | | | |
|---|---|---|---|---|
| 6,612,803 | B1 * | 9/2003 | McCartney | B66F 9/18 294/104 |
| 2003/0066665 | A1 | 4/2003 | Coombs et al. | |
| 2015/0117961 | A1 * | 4/2015 | Olsson | E21B 19/20 405/259.1 |

* cited by examiner

ROD MANIPULATOR FOR A MINING DRILL RIG

RELATED APPLICATION DATA

This application is a § 371 National Stage Application of PCT International Application No. PCT/EP2015/054797 filed Mar. 9, 2015 claiming priority of EP Application No. 14162337.1, filed Mar. 28, 2014.

FIELD OF INVENTION

The present invention relates to a mining drill rig mountable at a mobile mining machine and in particular, although not exclusively, to mining apparatus to install roof and/or sidewall bolts in a mining environment.

BACKGROUND ART

In order to maximise excavation and mineral recovery efficiency, mining machines have been developed for specific purposes. Whilst some machines are configured exclusively to cut the mineral from a deposit or seam, other machines are configured to tunnel within the subterranean depth to effectively create the mine and provide passageways for the mineral cutters. In particular, mobile mining machines have emerged as successful apparatus to both provide direct cutting at the seam and as a means of rapid entry roadway development. For example, a mobile mining machine comprises a rotatable cutting or mining head having cutting bits provided on rotating drums to contact the mineral face. The cutting head is conventionally mounted at a moveable boom so as to be adjustable in height relative to the mine floor. As the cutting head is rotated and advanced into the seam, the extracted mineral is gathered by a gathering head and then conveyed rearwardly by the mobile machine via conveying apparatus to create discharged stock piles for subsequent extraction from the mine.

Those machines that are adapted to create the mine passageways are typically fitted with roof and rib bolting rigs. The roof and rib bolts reinforce the roof and walls of the mine by interconnection with reinforcement formations. Due to the confined space in which the machine is operating, the bolting rigs are typically positioned immediately behind the cutting head and are required to be as small as possible whilst allowing access for personnel to interchange the drill rod used to create the borehole and the roof or rib bolt that is then driven into the as formed hole. Other mobile machines that employ drill and/or bolting rigs include dedicated bolters, roadheaders, platform bolters and the like. Example drill and bolting rigs are described in US 2003/066665; DE 102007038265; EP 1533470 and EP 0470061.

As will be appreciated, it is typically required to take out the drill rod to one side of the drilling centre whilst the bolt is installed into the borehole. Conventional arrangements are disadvantageous as they restrict access to the drill unit making it difficult to interchange the rod and bolt. Additionally, conventional rigs are typically bulking and are not easily accommodated in the restricted space available at the mining machine. Accordingly, what is required is a mining bolting drill rig that solves these problems.

SUMMARY OF THE INVENTION

It is an objective of the present invention to provide a bolting drill rig mountable at a mining machine and in particular a mobile mining machine that provides the automated or semi-automated manipulation of the drill rod towards and from the drilling position to allow convenient and rapid interchange of the drill rod and drilling bolt whilst minimising the space requirement for the rig at the machine. It is a further specific objective to provide a rod manipulator assembly at a bolter miner drill rig that does not increase significantly the overall size of the drill rig and is effective to provide unhindered access to the region of the drilling drive unit for convenient interchange of the drill rod and roof or rib bolt.

The objectives are achieved via a manipulator assembly mounted at the drill rig that carries a manipulator arm movable in a first lengthwise direction along the rig and a second lateral direction to transfer a drill rod between a drilling position and a laterally displaced storage position (to one side of the drilling position) via an automated or semi-automated movement mechanism.

The present manipulator assembly is configured specifically to minimise the additional space required at the region of the bolter drill rig so as to allow retro fitting to existing bolter drill rigs and mobile mining machines.

According to a first aspect of the present invention there is provided a manipulator assembly mountable at a bolting drill rig for a mobile mining machine, the manipulator assembly comprising: a manipulator frame; a manipulator arm mounted to move in a first lengthwise direction along the frame between a rod storage position and a rod drilling position; and a releasable rod engager provided at the arm to grip the rod for coupled movement with the arm during movement in the first lengthwise and second lateral directions; characterised in that: at least a part of the arm is mounted to move in a second lateral direction substantially perpendicular or transverse to the first direction between a retracted state to provide a drill rod in a storage position laterally to one side of a drive unit and an extended state to provide the drill rod in a drilling position centred with the drive unit.

According to a second aspect of the present invention there is provided a bolting drill rig mountable at a mining machine, the rig comprising: an elongate main frame; a drill drive unit to provide rotational drive to a drill rod used to create a bore hole in a mine roof or wall to receive a bolt; a head movably mounted at the frame being configured to brace against the roof or wall of the mine during drilling; and the drill rod manipulator assembly as claimed herein mountable at the frame; the manipulator arm mounted to move in the first lengthwise direction along the main frame between the rod storage position away from the head and the rod drilling position towards the head relative to the lengthwise direction of the main frame; the at least a part of the arm mounted to move in the second lateral direction substantially perpendicular or transverse to the first direction between the retracted state to provide the rod in the storage position laterally to one side of the drive unit and the extended state to provide the rod in the drilling position centred with the drive unit.

Advantageously, the manipulator frame is mounted rigidly to the main frame of the rig and is generally elongate to enable linear travel of the manipulator arm in a direction to one side and parallel to the linear advancing movement of the drill rod drive unit.

Optionally, the assembly may further comprise a linear actuator to drive linear movement of the arm in the first direction. According to further optional implementations, the arm may be driven by other conventional actuators such as chain drives, spools, cables, rack and pinion, hydraulic, pneumatic and/or electro-mechanical actuators. Such arrangements are advantageous to minimise the volume/space occupied by the manipulator assembly and to provide a generally compact construction at the drill rig.

Preferably, a distance by the manipulator assembly projects laterally from the main frame of the rig is equal to or less than a distance by which the drill drive unit projects laterally from the main frame. Preferably, a distance by which the manipulator assembly projects laterally from the main frame of the rig, is approximately equal to or less than a thickness of the main frame in a direction perpendicular to a length of the main frame. The manipulator assembly is accordingly compact in the direction perpendicular to the length of the main frame so as to enable convenient mounting at existing bolting drill rigs and to provide unhindered access to the axial centre of the drill drive unit mounted at an adjacent side of the drill rig.

Preferably, the drive unit is mounted at a first side of the main frame and the manipulator assembly is mounted at a second side of the main frame; wherein the arm is configured to move laterally in the second direction and to pivot between the retractor state and the extended state such that in the retracted state it does not obscure an axis centred on the drive unit and in the extended state provides the drill rod in the position centred with the drive unit. Such an arrangement is advantageous to provide unhindered access to the axial centre region of the rotational drive unit to allow personnel to quickly and conveniently interchange the drill rod and the roof or rib bolts.

Preferably, the drive unit is mounted at the main frame via a shuttle carriage to enable the drive unit to move lengthwise along the main frame relative to the head. Preferably, the head is mounted at the main frame via at least one linear actuator and configured to be extended from or retracted at the main frame relative to the drive unit.

Preferably, the manipulator arm comprises a base part mounted at and configured to slide along the manipulator frame; and an extender part capable of extending laterally from the base part in the second direction substantially perpendicular or transverse to the length of the main frame. The base part is capable of shuttling back and forth along the manipulator frame and comprises a low profile configuration to minimise occupied space. Similarly, the extender part may comprise a corresponding plate-like configuration to provide a low profile construction and to be capable of projecting laterally outward from the plate-like base part. Accordingly, the extender part is capable of sliding over and in near touching contact with the base part during lateral sideways extension and retraction.

Preferably, the manipulator assembly further comprises at least one linear actuator connecting the base part and the extender part to drive movement of the extender part in the second direction. Additionally, the assembly may further comprise at least one linear actuator connected between the base part and the manipulator frame to drive linear movement of the base part in the first direction along the manipulator frame. According to further specific implementations, the actuator configured to drive movement of the arm in both the first and second directions may comprise a chain drive, spools, cables, rack and pinion, hydraulic, pneumatic and/or electro-mechanical actuators.

The extender part is coupled to the base part via conventional mechanical linkages including pivot pins, pinions, cams, rockers, linear actuators, lug and slot arrangements and the like as will be appreciated to enable a predetermined mechanical movement of the extender part relative to the base part.

Preferably, the rod engager comprises a single jaw or a pair of opposed jaws to open and close to release and grip the drill rod. The opposed jaws enable the convenient and reliable grasping and release of the drill rod via an actuating mechanism that is triggered by the position of extension and pivoting of the extender part of the manipulator arm relative to the base part using conventional mechanical linkages involving pivot pins, pinions, cams, guide slots and the like as will be appreciated.

The drill rig and in particular the rod engager is also configured and compatible for use with roof/rib bolts and resin insertion devices (i.e., resin loading sticks) of various types. The present rig is accordingly capable of transporting the various elongate elements (drill rod, bolt, resin stick) between the use position, aligned with the drive motor, and the storage position.

The assembly may further comprise at least one actuator to drive a movement of the jaws to open and close about the drill rod.

Preferably, the assembly further comprises at least one pivot mounting connecting the base part to the extender part to enable the extender part to pivot relative to the base part. Preferably, the extender part is configured to pivot through 20 to 70° relative to the base part. The configuration of the extender part to pivot relative to the base part is advantageous to enable positioning of the manipulator assembly at an adjacent side of the drill rig relative to the drive unit. Accordingly, the present manipulator assembly does not obstruct or hinder access to the part of the drill rig that mounts the drill rod in the drilling position centred at the drive unit.

Optionally, a length of the manipulator frame is at least half a length of the main frame such that the arm is capable of moving in the first direction over at least half of the length of the main frame to move the rod in a direction away from the head. Such an arrangement is advantageous to provide sufficient linear travel of the manipulator arm away from the head plate of the rig so as to allow rearward transport of the drill rod into the storage position. The drill rig is therefore enabled to operate to allow the drive unit to drill the roof or rib bolt into the as-formed bore created by the drill rod.

According to a third aspect of the present invention there is provided a mobile mining machine for roof or wall bolting comprising a rig as claimed herein.

BRIEF DESCRIPTION OF DRAWINGS

A specific implementation of the present invention will now be described, by way of example only, and with reference to the accompanying drawings in which.

DETAILED DESCRIPTION OF PREFERRED EMBODIMENT OF THE INVENTION

The subject invention will be described with reference to a specific implementation mounted upon a bolter miner being an electrically powered, track-mounted continuous mining machine designed to excavate roadways and install roof bolts simultaneously. However, as will be appreciated, the present rig and manipulator arm may be mounted on a variety of mining machines that employ drill and/or bolting rigs including dedicated bolters, roadheaders, platform bolters and the like.

Figure 1:
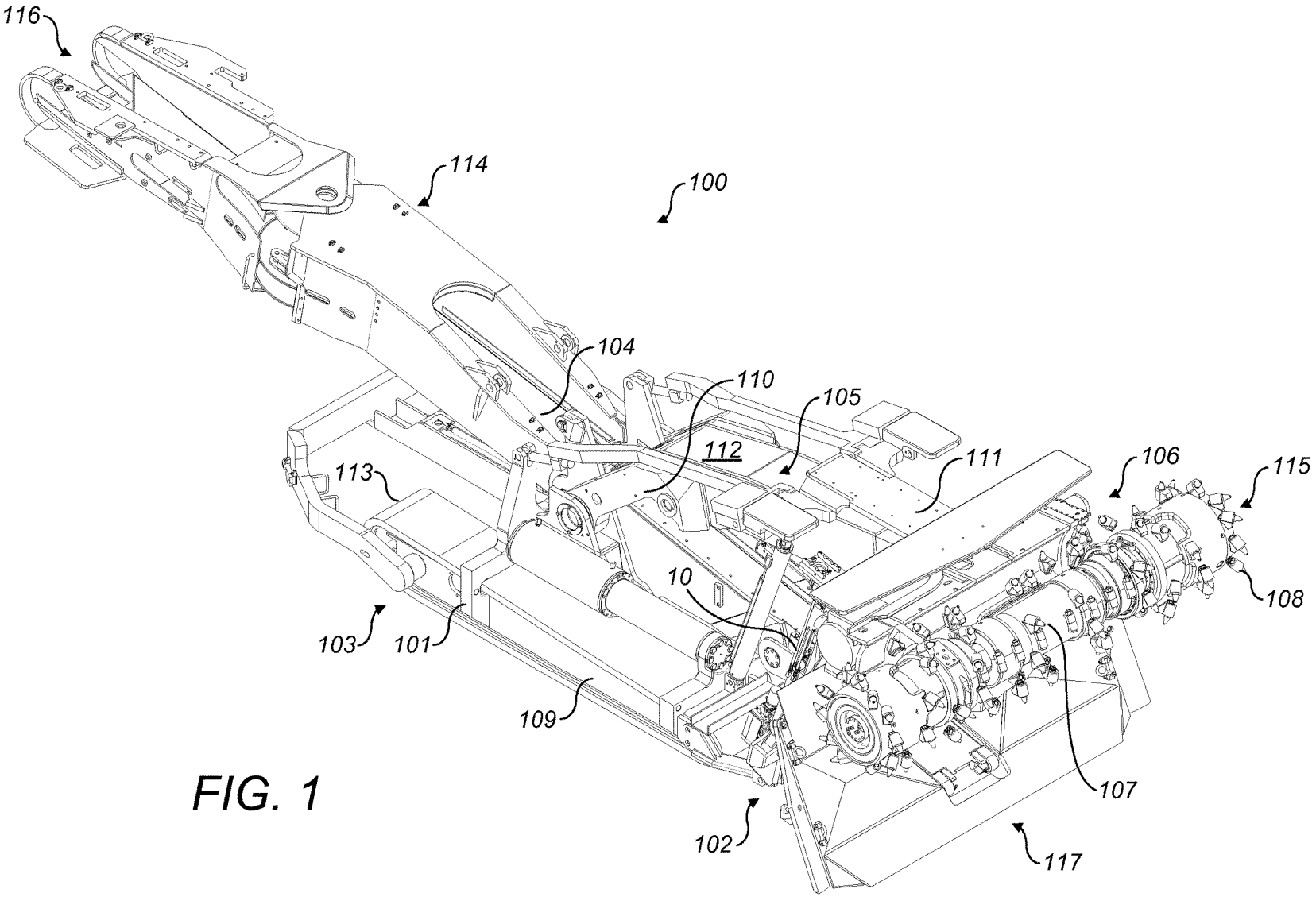
FIG. 1 is a perspective view of a mobile mining machine comprising a pair of bolter drill rigs mounted immediately behind a cutting and gathering head provided at a forward end of the machine according to a specific implementation of the present invention.
Figure 2:
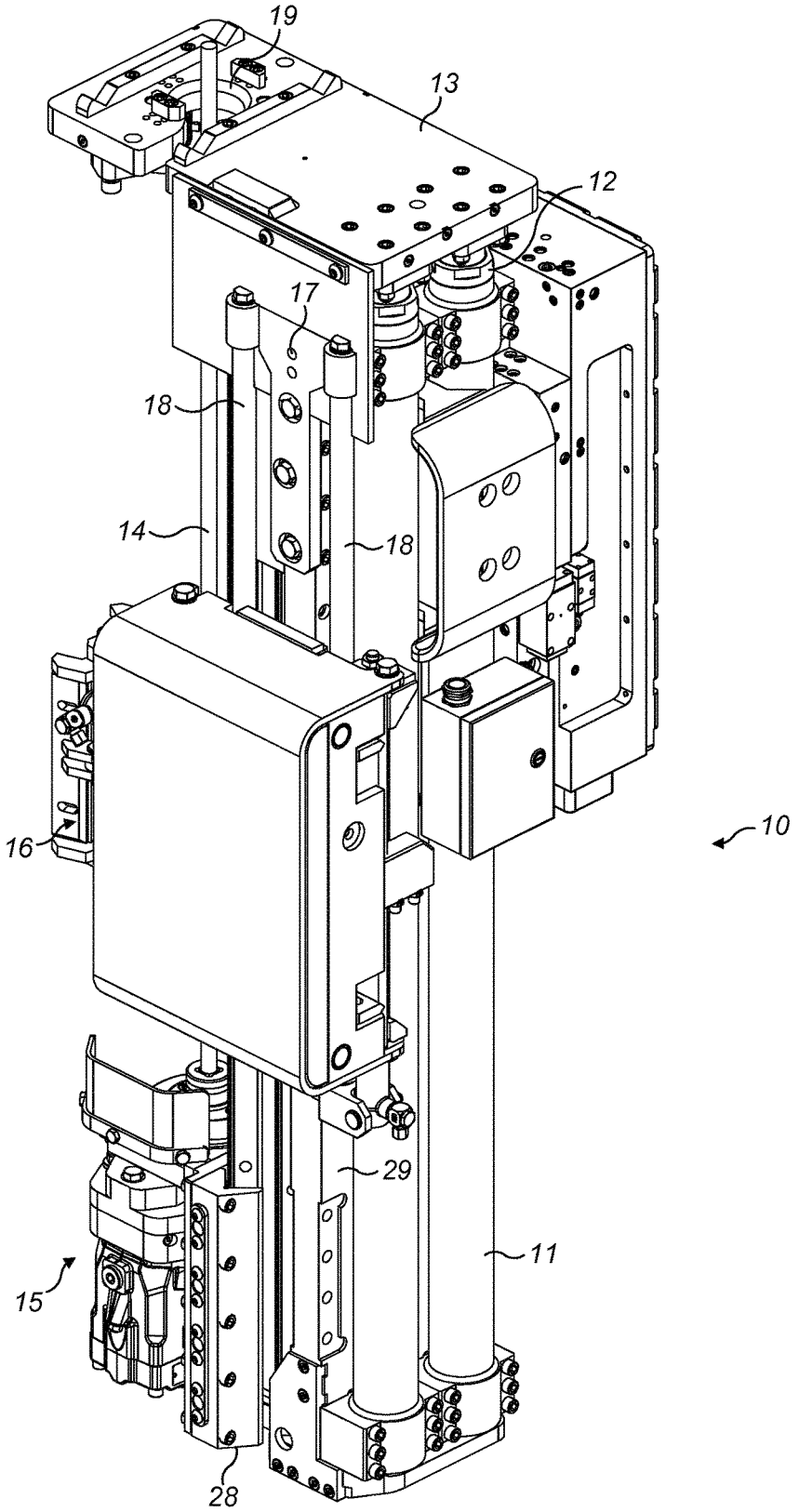
FIG. 2 is an external perspective view of the bolter drill rig of FIG. 1 having a manipulator assembly configured to transport a drill rod between a drilling and a storage position according to a specific implementation of the present invention.
Figure 3:
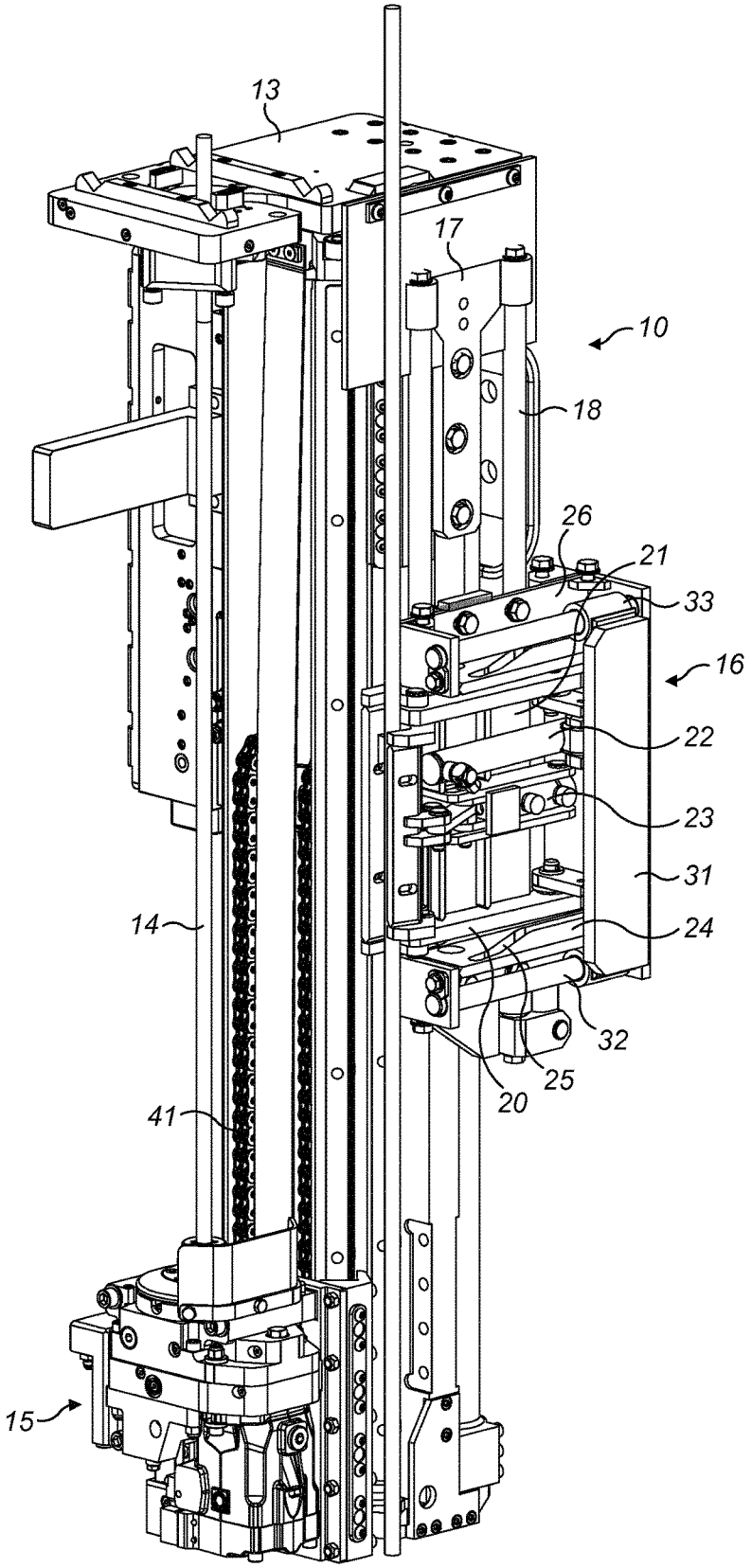
FIG. 3 is a further perspective view of the rig of FIG. 2.
Figure 4:
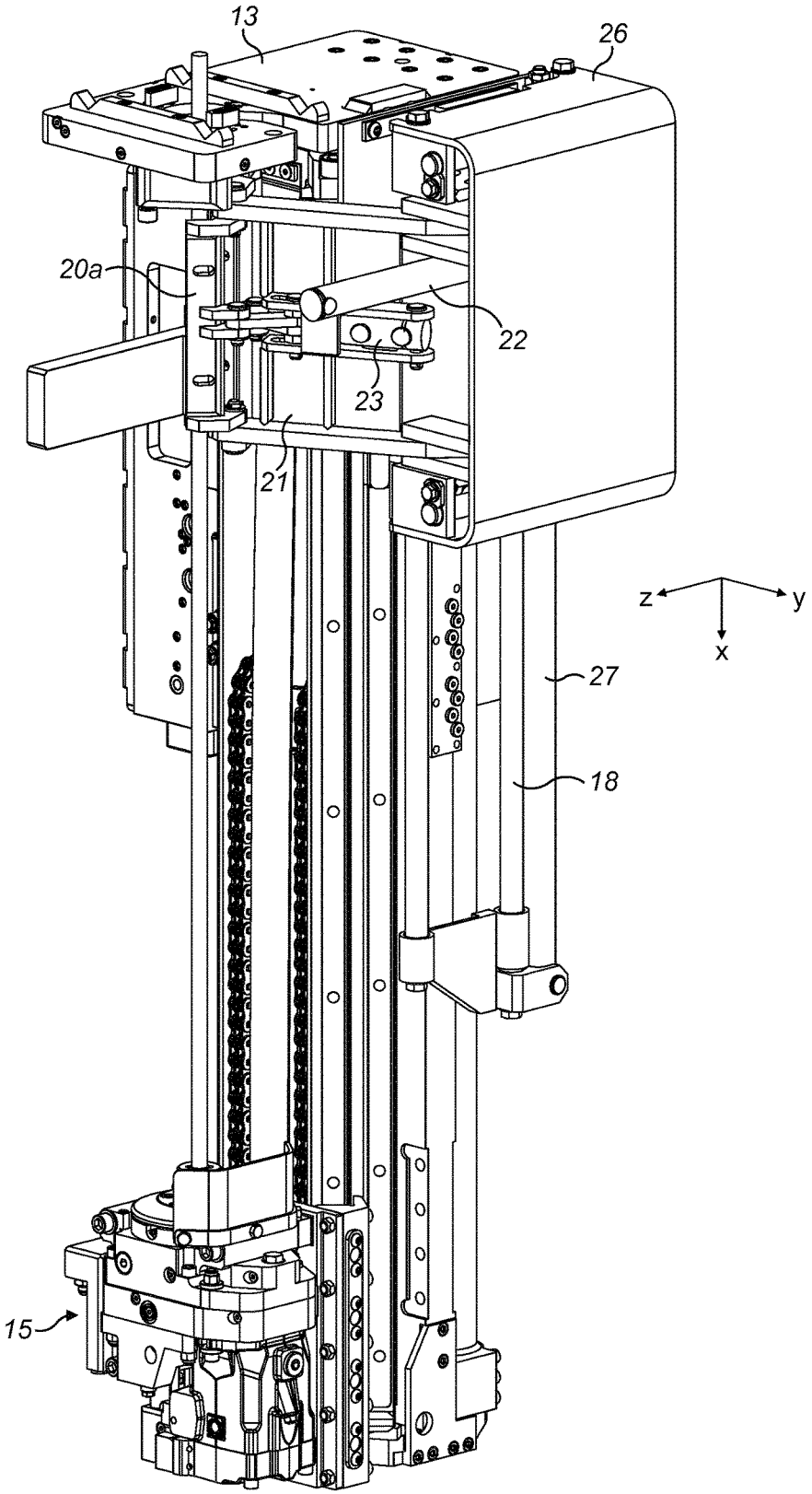
FIG. 4 is a further perspective view of the rig of FIG. 3.
Figure 5:
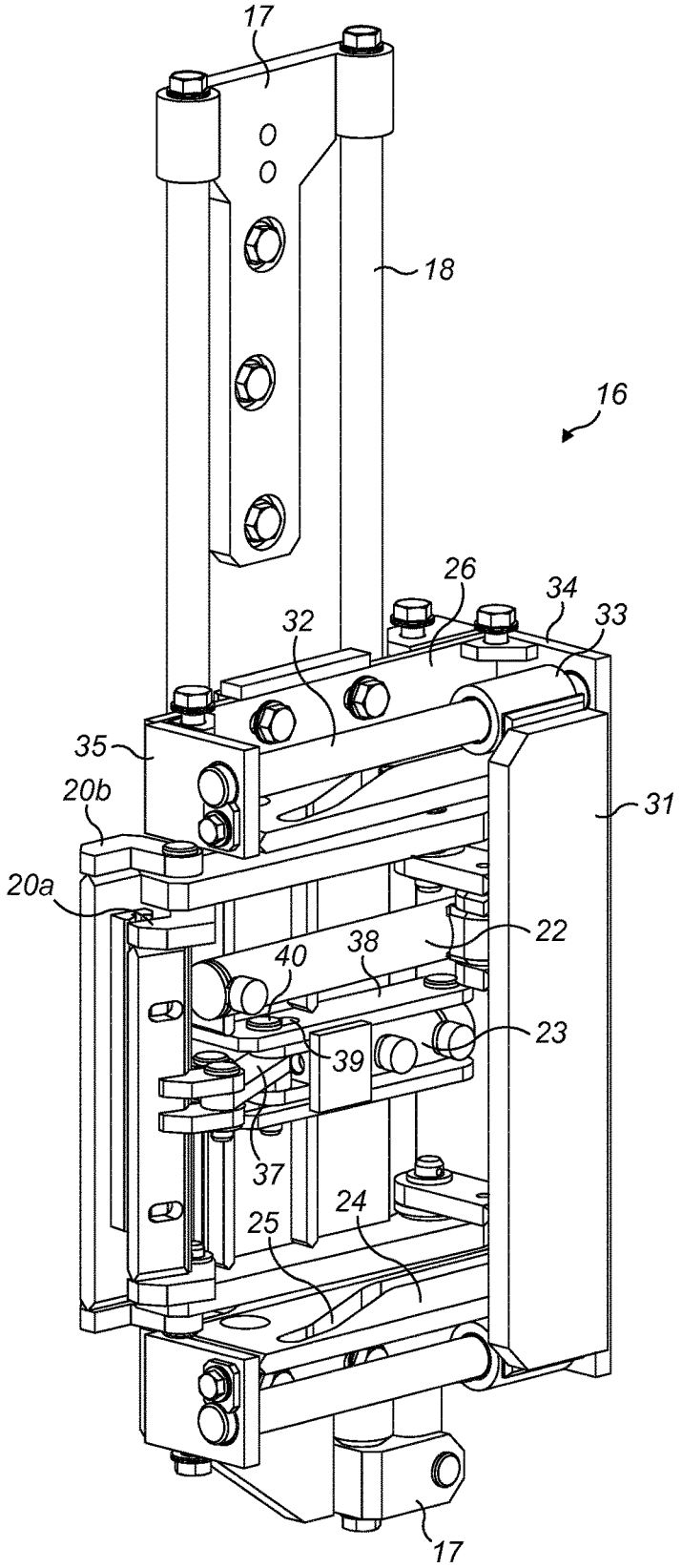
FIG. 5 is a perspective view of the manipulator assembly with parts removed for illustrative purposes.
Figure 6:
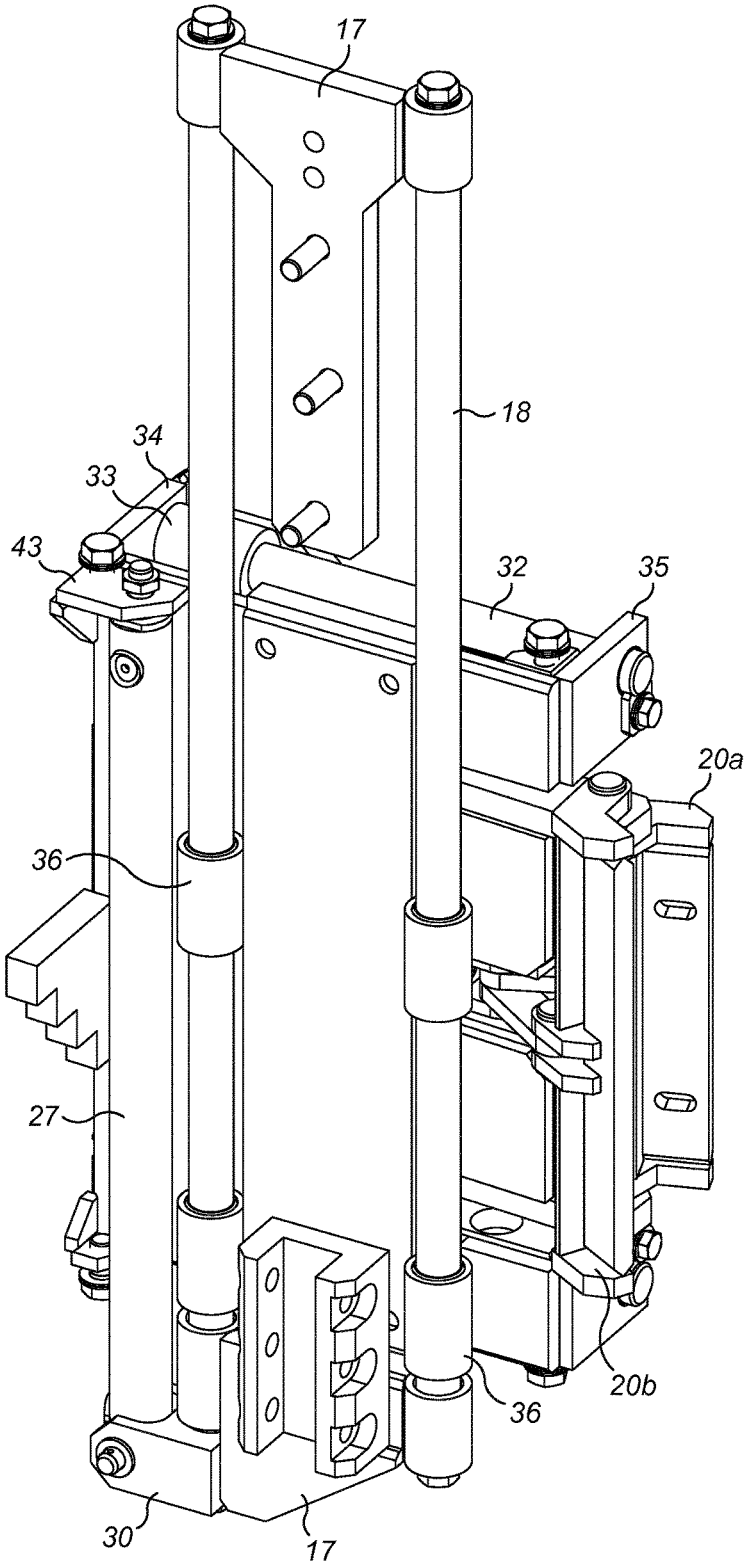
FIG. 6 is a further perspective view of the manipulator assembly of FIG. 5 with parts removed for illustrate purposes.
Figure 7:
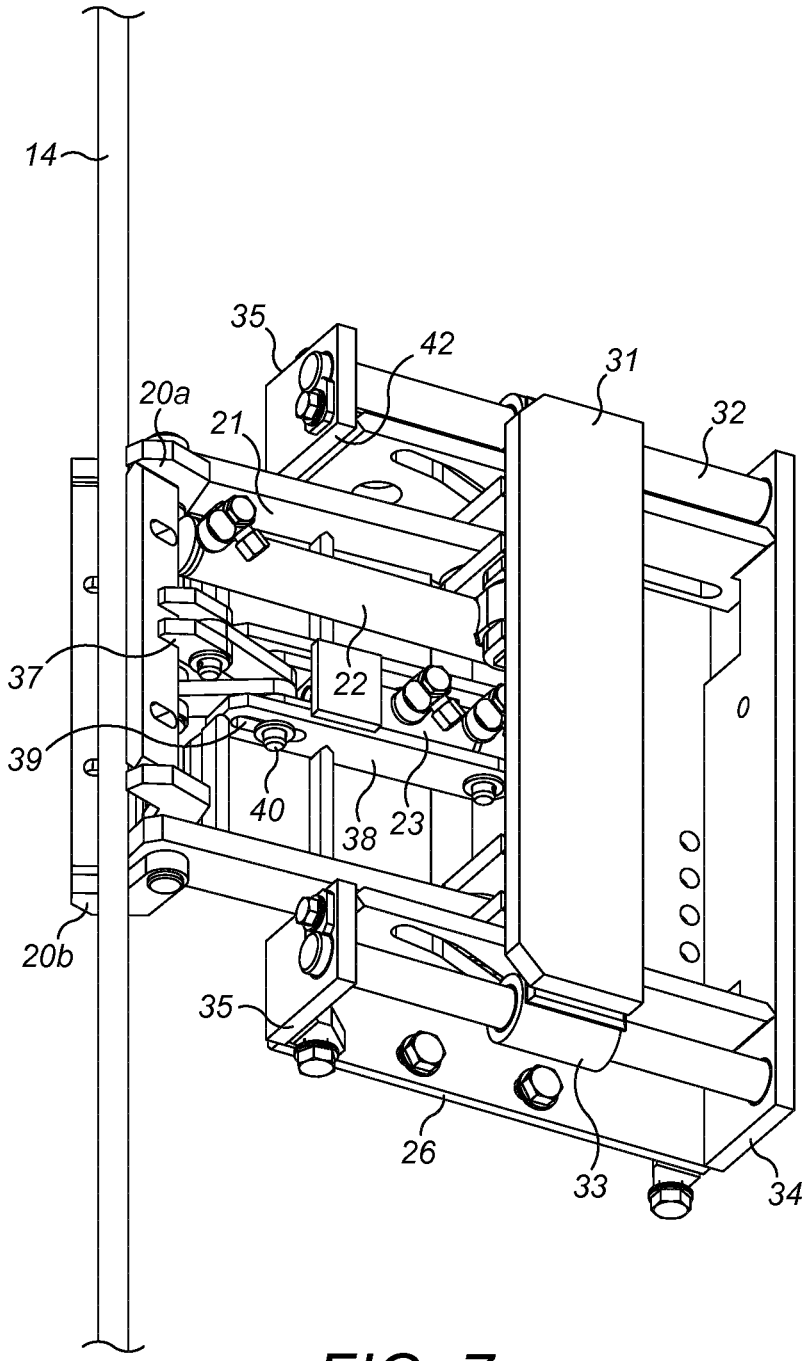
FIG. 7 is a further perspective view of the manipulator assembly of FIG. 6 with parts removed for illustrate purposes.
Figure 8:
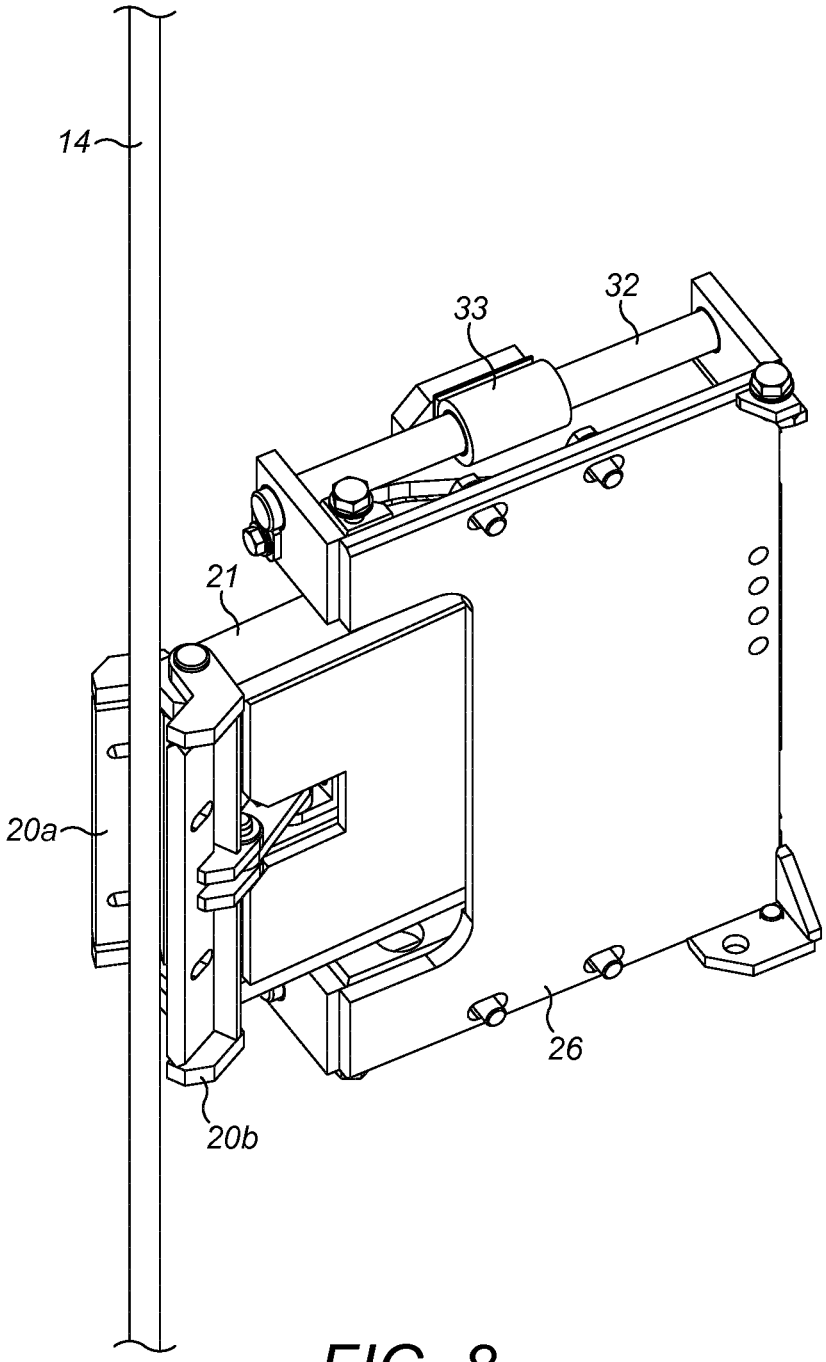
FIG. 8 is a further perspective view of the manipulator assembly of FIG. 7 with parts removed for illustrate purposes.

Referring to FIG. 1, a mining machine 100 comprises a main frame 101 that provides support for an undercarriage or chassis 109 that supports a pair of endless driven tracks 113 for propelling the machine 100 over the ground and along a tunnel to advance forwardly through a material deposit seam. Main frame 101 comprises a generally forward end 102 and a generally rearward end 103. A conveyor 104 extends substantially from forward end 102 to rearward end 103 and is adapted to carry material dislodged from the cutting face for subsequent discharge and stock piling at a remote location optionally using additional conveying and mining apparatus. A movable cutting boom 105 is pivotally mounted at one end 112 to main frame 101 via a pivot mounting 110 and comprises a second end 106 mounting a cutting head 115 that in turn mounts a plurality of rotatable drums 107. Cutting bits 108 project radially from each drum 107 and are specifically adapted to cut into and dislodge the mineral material to be mined from the seam. Boom 105 and in particular end 106 is capable of being raised or lowered relative to main frame 101 and endless tracks 113 to enable machine 100 to cut the seam face over a varying height range above the ground of the mine tunnel. Boom 105 is operated by hydraulic rams and other associated components as will be appreciated by those skilled in the art. Machine 100 further comprises a gathering head 117 mounted at forward end 102 of main frame 101. Head 117 is configured to collect material removed from the deposit seam by the cutting action of head 115. The cut material is then transported rearwardly from gathering head 117 via conveyor 104.

A canopy 111 comprises a vertically uppermost region having a generally planar configuration and is adapted for being raised vertically upward from frame 101 in a manner similar to cutting head 115 so as to contact the mine roof to provide structural support as necessary during the cutting and roof bolting operations. Additionally, a tail section 114 projects rearwardly from the rearward end 103 of frame 101 to carry rearwardly conveyor 104 to a discharge end 116 representing a rearwardmost part of the continuous machine 100. Cutting head 115 is mounted at the forwardmost end 106 of cutting boom 105 and is positionally supported by a pair of gear carriers 302 that extend from boom 105 and couple head 115 to machine 100. A pair of bolter drilling rigs 10 is mounted at the frame forwardmost end 102 immediately behind cutting and gathering heads 115, 117 and laterally to either side of boom 105. Each rig 10 is configured for operation in two modes including a first drilling mode in which a drill rod is driven into the mine roof or sidewall to create a borehole and a second mode in which a roof or rib bolt is driven by the same drive motor into the as-formed borehole.

Referring to FIGS. 2 to 8, the bolter rig 10 comprises an elongate main frame to mount various moving components of the rig and various static components. The main frame comprises, in part, a pair of parallel elongate support struts 11 extending lengthwise along a frame gantry 29. A rotational drive motor indicated generally by reference 15 is mounted via a carriage shuttle 28 to gantry 29. A chain drive 41 provides a movable link between carriage 28 and gantry 29 to enable drive motor 15 to move linearly in a longitudinal direction x along the main frame 11, 29.

Each of the support struts 11 mounts internally a respective linear actuator 12 capable of liner extension and retraction relative to struts 11. A head plate 13 is attached to respective endmost regions of each actuator 12 such that by actuation, head plate 13 is capable of lengthwise extension in direction x from struts 11 and gantry 29. Head plate 13 is configured specifically for positioning in contact with a mine roof or wall during drilling and bolting procedures. Plate 13 comprises an aperture 19 through which a drill rod 14 and a roof or rib bolt (not shown) are capable of passing during drilling and bolting operations. Aperture 19 is centred on a longitudinally axis of drive unit 15 corresponding to the axis of rod 14 when installed and positioned at the drive unit 15 for drilling parallel to x direction. In a typical drilling operation, drive unit 15 is configured to engage drill rod 14 and then to advance linearly along frame parts 11, 29 towards head plate 13 that is maintained in an extended position from frame 11, 29 in contact with the mine roof or wall. Once a borehole is created, rod 14 is retracted via a reverse linear movement of drive unit 15 (via chain drive 41) along frame 11, 29. A roof or rib bolt (not shown) is then installed and centred at drive unit 15 which is advanced a second time towards head plate 13 to embed the bolt into the as-formed bore at the mine roof or wall.

The present bolter mining rig 10 is configured specifically for the automated or semi-automated displacement of the drill rod relative to drive unit 15 to enable convenient and rapid interchange of the drill rod and the roof or rib bolt. In particular, rig 10 comprises a drill rod manipulator assembly represented generally by reference 16. The assembly comprises a pair of spaced apart and parallel elongate bars 18 mounted at respective first and second ends via respective attachment braces 17. Each brace 17 is rigidly mounted to one side of main frame gantry 29 in an orientation such that bars 18 are aligned parallel with struts 11. Braces 17 are mounted at one side of the drill rig 10 whilst the drive unit 15 and carriage 28 are positioned at an adjacent second side of the rig 10 to allow unhindered longitudinal travel of the drive unit 15 in the x direction towards and from head plate 13. Bars 18 and braces 17 are substantially rigidly mounted at rig 10 so as to be stationary. Manipulator assembly 16 further comprises a shuttling component that is configured to shuttle linearly along bars 18 in a parallel direction of travel relative to drive unit 15. In particular, the movable components comprises a manipulator arm having a base part represented generally by reference 26 and an extender part represented generally by reference 21. Base part 26 is movably mounted on each bar 18 via a first pair and a second pair of spaced apart sleeves 36 capable of sliding linearly along each bar 18. Base part 26 comprises a flange 43 that mounts one end of a linear actuator 27 mounted at an opposite end to a boss 30 rigidly mounted to actuator frame base 17. Accordingly, actuator 27 via linear extension and retraction is configured to drive sliding movement of base part 26 along bars 18 in the x direction towards and away from drive unit 15 and head plate 13.

Base part 26 further comprises a rear wall 34 and a front wall 35 extending in a lengthwise direction of base part 26. A pair of guide rails 32 extends between walls 34 and 35 at each opposite lengthwise end of base part 26 in a direction perpendicular to bars 18. A bridge plate extends lengthwise between rails 32 and is mounted for sliding movement along rails 32 via a pair of respective mounting sleeves 33 provided at each end of bridge plate 31. Base part 26 further comprises a pair of widthwise extending walls 24, each comprising a curved elongate slot 25 extending in a direction between the front and rear walls 35, 34.

The extender part 21 of the manipulator arm is movably mounted at base part 26 via a linear actuator 22. Extender part 21 is connected to bridge plate 31 such that actuation of bridge plate 31 for travel along the rails 32 imparts a lateral extension of extender part 21 from base part 26 in a direction z perpendicular to bars 18 and the x direction of travel of drive unit 15. Extender part 21 extends laterally outward from base part 26 via an aperture 42 formed in the front wall 35 of base part 26.

Extender part 21 further comprises a mount wall 38 extending in the z direction parallel to rails 32 and comprising an elongate slot 39 provided at one end. A pivot pin 40 mounts a pair of hinging scissor arms 37 capable of opening and closing about pivot 40. Each of the scissor arms 37 mount a respective first jaw 20*a* and a second jaw 20*b* configured to open and close relative to one another to release and grip drill rod 14 via a claw like engaging action. Jaws 20*a*, 20*b* are actuated by a linear actuator 23 mounted at extender part 21 that is mounted in turn at support mount wall 38. That is, actuator 23 provides displacement of pivot pin 40 within slot 39 that acts to pivot scissor arms 37 to open and close jaws 20*a*, 20*b*.

Extender part 21 is hingebly mounted at base part 26 with the hinging facilitated via engagement of a pair of lugs (not shown) configured to travel within the elongate curved slots 25. When actuated, bridge plate 31 is configured to move along rails 32 to force extender part 21 laterally outward from base part 26 in the z direction perpendicular to bars 18 orientated in the x direction. Via the pivot mounting of extender part 21 at base part 26, the extender part 21 is configured to pivot downwardly (or upwardly) relative to base part 26 out of plane with the base part 26 and bars 18. This pivoting action occurs when the extender part 21 is displaced laterally sideward and is moved to its fully extended position. In the fully extended position, jaws 20*a*, 20*b* are approximately centred on the drilling axis of drive unit 15 corresponding to the longitudinal axis of drill rod 14 when engaged in position for drilling.

Manipulator assembly 16 is advantageously mounted at a different and adjacent side of drill rig 10 relative to the drive unit 15 and carriage 28 to allow unhindered access to the region of the longitudinal axis centred on drive unit 15 for interchange of the drill rod 14 with a roof or rib bolt (not shown). Such a configuration necessitates a manipulator arm assembly 16 configured to 'reach' sideways (in the z direction and then to pivot and travel in the y direction) from the region of mounting of the manipulator 16 towards the axial centre of drive unit 15. Accordingly, extender part 21 is capable of moving laterally sideways to be brought into position at the appropriate side of the rig 10 to either remove or deliver a drill rod 14 to the axially centred position at drive unit 15. Additionally, in order to provide unhindered roof or rib bolting once the borehole has been created by drill rod 14, the manipulator arm is configured to shuttle rearwardly away from head plate 13 in the x direction towards drive unit 15 so as to carry rod 14 to a storage position both at the side of mounting of the manipulator assembly 16 and also a linearly retracted position away from head plate 13. Accordingly, the present manipulator arm is configured to reliably transport drill rod 14 between a drilling position centred at unit 15 and a storage position displaced laterally to one side of drive unit 15 and axially rearward from head plate 13.

According to the subject invention, manipulator assembly 16 comprises a compact construction so as to minimise the occupied volume at the mounting side of main frame 11, 29. In particular, a distance in the y direction by the manipulator assembly 16 projects laterally from the main frame 11, 29 is less than a distance in the y direction by which drive unit 15 projects laterally from main frame 11, 29 (including carriage 28). Additionally, the distance in the y direction by which the manipulator assembly 16 projects laterally from main frame 11, 29 is approximately equal to or less than a thickness of the main frame 11, 29 in the y direction perpendicular to a length of the main frame in the x direction. The present manipulator 16 may therefore be conveniently mounted at an existing bolter drill rig 10 and mobile mining machine 100 without modification so as to be positioned immediately behind heads 115, 117 and adjacent boom 105.

The invention claimed is:

1. A rod manipulator mountable at a mining machine near a drill drive unit and configured for moving a rod used for drilling or bolting operations, the manipulator-comprising:

a manipulator frame mountable at a frame of the mining machine;

a manipulator arm mounted to move in a first lengthwise direction along the manipulator frame between a rod storage position and a rod drilling position; and a releasable rod engager provided at the arm to grip the rod for coupled movement with the arm, wherein at least a part of the arm is mounted to move in a second lateral direction substantially perpendicular or transverse to the first direction between a retracted state to provide the rod in the storage position laterally to one side of the drive unit and an extended state to provide the rod in the drilling position centered with the drive unit, the manipulator arm including a base part mounted at and configured to slide along the manipulator frame and an extender part arranged to extend laterally from the base part in the second lateral direction substantially perpendicular or transverse to the first lengthwise direction.

2. The rod manipulator as claimed in claim 1, further comprising at least one linear actuator connecting the base part and the extender part to drive movement of the extender part in the second lateral direction.

3. The rod manipulator as claimed in claim 1, further comprising at least one linear actuator connected between the base part and the manipulator frame to drive linear movement of the base part in the first lengthwise direction along the manipulator frame.

4. The rod manipulator as claimed in claim 1, wherein the rod engager includes a single jaw or a pair of opposed jaws to open and close to release and grip the drill rod and at least one actuator to drive a movement of the jaw or jaws to open and close about the drill rod.

5. The rod manipulator as claimed in claim 1, further comprising at least one pivot mounting connecting the base part to the extender part to pivot the extender part relative to the base part.

6. The rod manipulator as claimed in claim 5, wherein the extender part is configured to pivot 20 to 70° relative to the base part.

7. A bolting drill rig mountable at a mining machine, the rig comprising:

an elongate main frame;

a drill drive unit arranged to provide rotational drive to a drill rod used to create a bore hole in a mine roof or wall to receive a bolt;

a head movably mounted at the frame and being configured to brace against the roof or wall of the mine during drilling, wherein a length of the manipulator frame is at least half a length of the main frame, such that the arm is arranged to move in the first direction over at least half of the length of the main frame to move the rod in a direction away from the head; and a drill rod manipulator assembly mounted at the main frame, the drill rod manipulator assembly including a manipulator frame mountable at the frame, a manipulator arm mounted to move in a first lengthwise direction along the main frame between the rod storage position away from the head and a rod drilling position towards the head relative to the lengthwise direction of the main frame and a releasable rod engager provided at the arm to grip the rod for coupled movement with the arm, at least a part of the arm being mounted to move in a second lateral direction substantially perpendicular or transverse to the first direction between a retracted state to provide the rod in the storage position laterally to one side of the drive unit and an extended state to provide the rod in the drilling position centered with the drive unit.

8. The rig as claimed in claim 7, wherein a distance that the manipulator assembly projects laterally from the main frame is equal to or less than a distance by which the drive unit projects laterally from the main frame.

9. The rig as claimed in claim 7, wherein the drive unit is mounted at a first side of the main frame and the manipulator assembly is mounted at a second side of the main frame, wherein the arm is configured to move laterally in the second direction and to pivot between the retracted state and the extended state such that in the retracted state the arm does not obscure an axis centered on the drive unit and in the extended state provides the drill rod in the position centered with the drive unit.

10. The rig as claimed in claim 7, wherein the drive unit is mounted at the main frame via a shuttle carriage to enable the drive unit to move lengthwise along the main frame relative to the head.

11. The rig as claimed in claim 10, wherein the head is mounted at the main frame via at least one linear actuator and configured to be extended from or retracted at the main frame relative to the drive unit.

12. A mobile mining machine for a roof or wall bolting comprising a rig as claimed in claim 7.

* * * * *